US007947209B2

(12) United States Patent
Srostlik et al.

(10) Patent No.: US 7,947,209 B2
(45) Date of Patent: May 24, 2011

(54) DEVICE AND METHOD FOR THE PRODUCTION OF A WATER BARRIER IN AN UNHARDENED ROOF TILE

(75) Inventors: Peter Srostlik, Maintal (DE); Günter Weiss, Offenbach (DE)

(73) Assignee: Lafarge Roofing Technical Centers GmbH, Oberursel (DE)

( * ) Notice: Subject to any disclaimer, the term of this patent is extended or adjusted under 35 U.S.C. 154(b) by 529 days.

(21) Appl. No.: 11/908,031

(22) PCT Filed: Mar. 7, 2006

(86) PCT No.: PCT/EP2006/002079

§ 371 (c)(1),
(2), (4) Date: Jan. 21, 2008

(87) PCT Pub. No.: WO2006/094759

PCT Pub. Date: Sep. 14, 2006

(65) Prior Publication Data

US 2009/0309263 A1 Dec. 17, 2009

(30) Foreign Application Priority Data

Mar. 9, 2005 (DE) ..... 10 2005 011 201

(51) Int. Cl.
*B28B 5/00* (2006.01)
*B28B 3/02* (2006.01)

(52) U.S. Cl. ..... 264/297.9; 264/297.6; 264/297.7; 264/336; 425/262; 425/413; 425/469

(58) Field of Classification Search ..... 264/297.6, 264/297.7, 336; 425/469, 262, 413
See application file for complete search history.

(56) References Cited

U.S. PATENT DOCUMENTS

| | | | | |
|---|---|---|---|---|
| 2,644,217 | A * | 7/1953 | Agar | 264/148 |
| 3,606,652 | A | 9/1971 | Hammond | |
| 3,631,574 | A | 1/1972 | Chapman | |
| 5,004,415 | A | 4/1991 | Schulz | |
| 5,772,939 | A * | 6/1998 | Palm et al. | 264/145 |

FOREIGN PATENT DOCUMENTS

| | | |
|---|---|---|
| DE | 279 528 | 6/1912 |
| DE | 1812456 | 8/1969 |
| DE | 2508 551 | 3/1976 |
| DE | 35 22 846 | 1/1987 |
| EP | 0 960 707 | 12/1999 |

(Continued)

OTHER PUBLICATIONS

International Preliminary Report on Patentability PCT/EP2006/002079 (English translation).

(Continued)

*Primary Examiner* — Yogendra N Gupta
*Assistant Examiner* — Alison Hindenlang
(74) *Attorney, Agent, or Firm* — Nils H. Ljungman & Associates

(57) ABSTRACT

The invention relates to a device and a method for producing a water barrier in unsolidified roof tile preforms. The inventive device comprises a molded piece with a recess as well as a die. The molded piece is disposed above the end of a roof tile perform, whereupon all or part of the rear edge of the roof tile perform is pressed upward by means of the die. The roof tile perform is then dried.

15 Claims, 5 Drawing Sheets

FOREIGN PATENT DOCUMENTS

Figure 1:
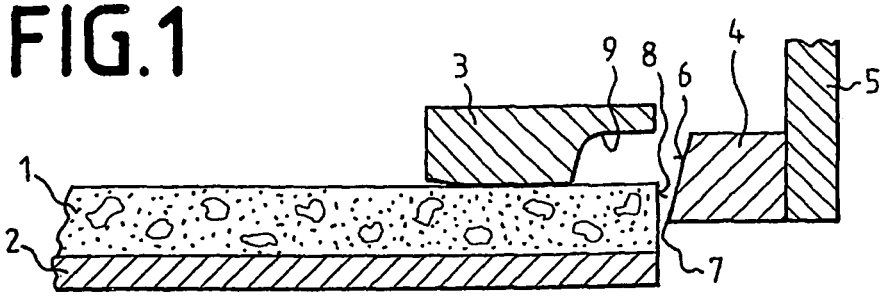

| | | |
|---|---|---|
| GB | 664 010 | 1/1952 |
| GB | 707 172 | 4/1954 |
| GB | 1 242 441 | 8/1971 |
| GB | 1514926 | 6/1978 |
| JP | 56 055 216 | 5/1981 |
| JP | 57 100013 | 6/1982 |
| JP | 57 126614 | 8/1982 |
| JP | 57 151752 | 9/1982 |
| JP | 57 163516 | 10/1982 |
| WO | WO 87/02299 | 4/1987 |

OTHER PUBLICATIONS

International Search Report PCT/EP2006/002079 and English translation thereof.

* cited by examiner

DEVICE AND METHOD FOR THE PRODUCTION OF A WATER BARRIER IN AN UNHARDENED ROOF TILE

In the production of concrete roofing tiles according to the extrusion molding process, onto a driven line, conveyed at constant speed, of abutting bottom halves of molds of equal length an unset concrete layer is applied in the form of an endless band. This band is formed by molding tools on the top side according to the surface contour customary for concrete roofing tiles. The continuously applied unset concrete layer is subsequently cut in a cutting station at each end of the bottom mold half of the mold by means of a cutting tool formed as a blade, such that each bottom mold half carries a single molded part, here a molded unfinished concrete roofing tile. The molded concrete roofing tile subsequently hardens in a drying chamber while still in its bottom mold half and is subsequently provided with a surface coating. A method and a device for the production of such concrete roofing tiles are described in DE 35 22 846 A1 and AT 400 120 B.

In order to obtain sufficient impermeability to driving rains in the case of roofs covered with concrete roofing tiles of the above described type, it is necessary that the concrete roofing tiles overlap in a ridge-eaves line. The particular length of the overlap is therein dependent on the particular roof pitch, i.e. in the case of a very steep roof pitch, the overlap can be less than if the pitch of the roof is less.

The use of these concrete roofing tiles in roofs with a pitch of less than 22°, among which are in particular non-inhabited commercial buildings, is problematic. Since in this case a very large overlap length of the roofing tiles is required, between ridge and eaves a very large number of parallel roofing tile rows must be placed. The large requirement of roofing tiles and the preparation of a roof batten construction, adapted to the number of rows of roofing tiles, considerably increase the material and work expenditures. Commercial buildings are therefore frequently covered with less expensive and lighter roofing materials, such as for example metal sheeting or fiber-reinforced cement plates.

To be able to employ nevertheless in these buildings concrete roofing tiles without disadvantage, there has been a change to providing the concrete roofing tiles on their top side in the proximity of their head end margin with a water barrier, which prevents rain from being driven in. In this way the high material and working expenditures can be avoided.

DE 18 12 456 A1 and DE 25 08 551 A1 disclose methods and devices which are suitable for providing green concrete roofing tiles resting in the lower half of the mold with a water barrier. In both methods first the water barrier is formed from separately provided unset concrete, which barrier is subsequently pressed onto the top side of the green concrete roofing tile in the proximity of the head end margin.

Furthermore, devices are known for the production of roofing tiles having a projection at one end which extends transversely (GB 707 172, FIGS. 13 to 15, and GB 664 010 A, FIGS. 3 to 7).

The invention addresses the problem of providing a method and a device for the production of concrete roofing tiles including water barriers, which is suitable for relatively high production cycle numbers and simultaneously ensures improved and permanent functionality of the water barrier.

This problem is solved according to the characteristics of patent claims 1, 18, 22 or 30.

The invention consequently relates to a device and a method for the production of water barriers in green roofing tiles which are not yet set. The device comprises a molding body with a recess as well as a ram. The molding body is disposed above the end of a molded unfinished roofing tile. Subsequently, the rear edge of the molded unfinished roofing tile is pressed, entirely or partially, upwardly with the ram. The molded unfinished roofing tile subsequently dries.

The advantage attained with the invention lies in particular therein that, in comparison to the solutions known from prior art, no separate unset concrete is utilized, such that between the water barrier and the concrete roofing tile no joining site tending to the formation of cracks is generated.

Furthermore, the water barrier can be produced in a production line on several roofing tiles successively and at the conventional production speed.

Figure 2:
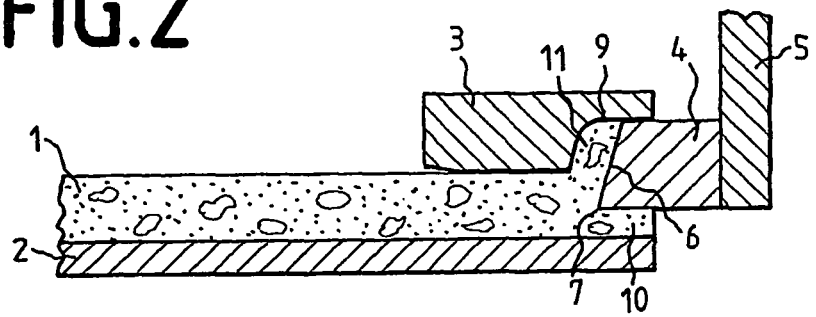
Figure 3:
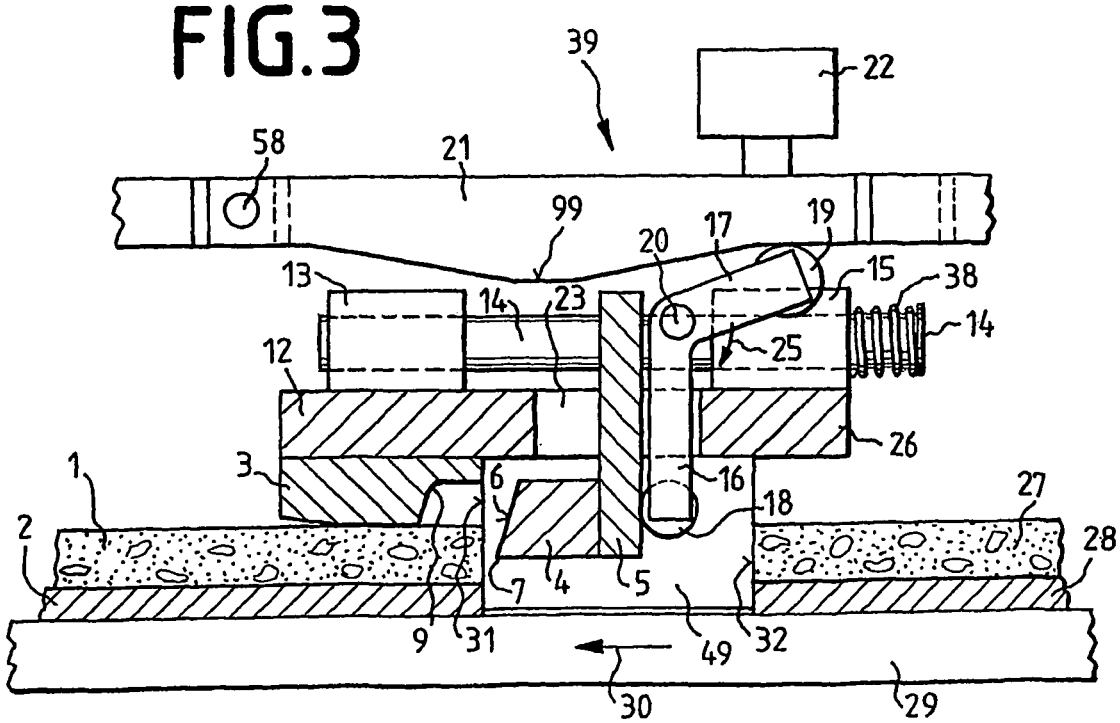
Figure 4A:
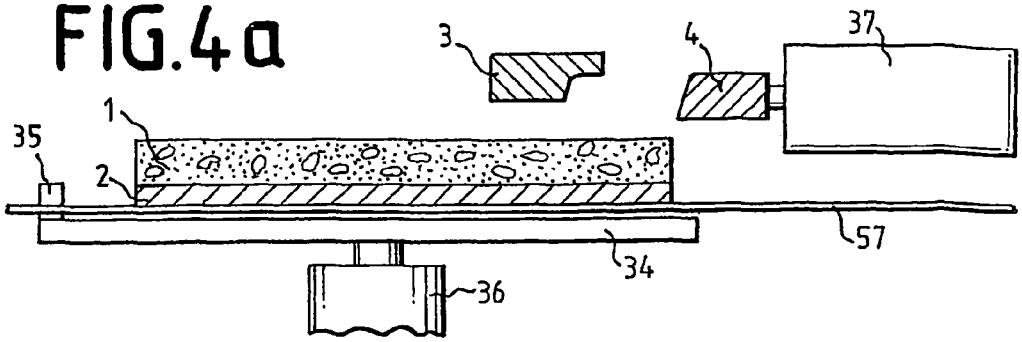
Figure 4B:
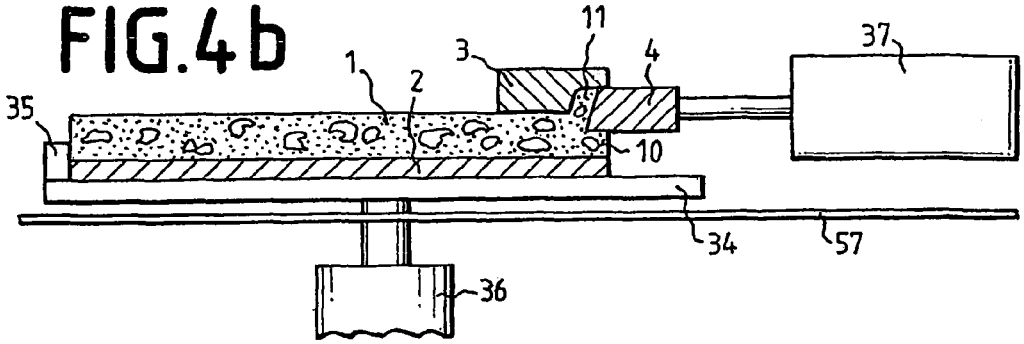
Figure 5:
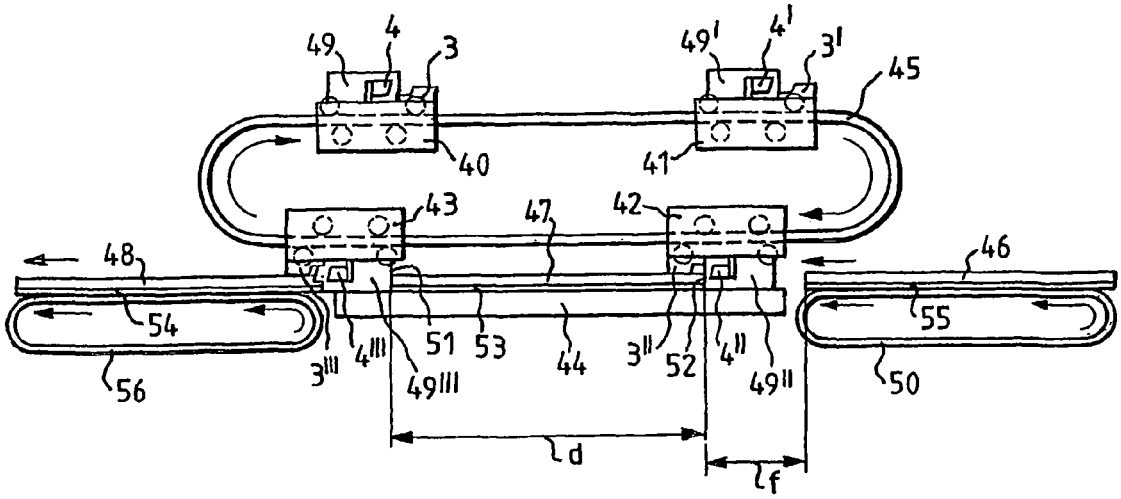
Figure 6:
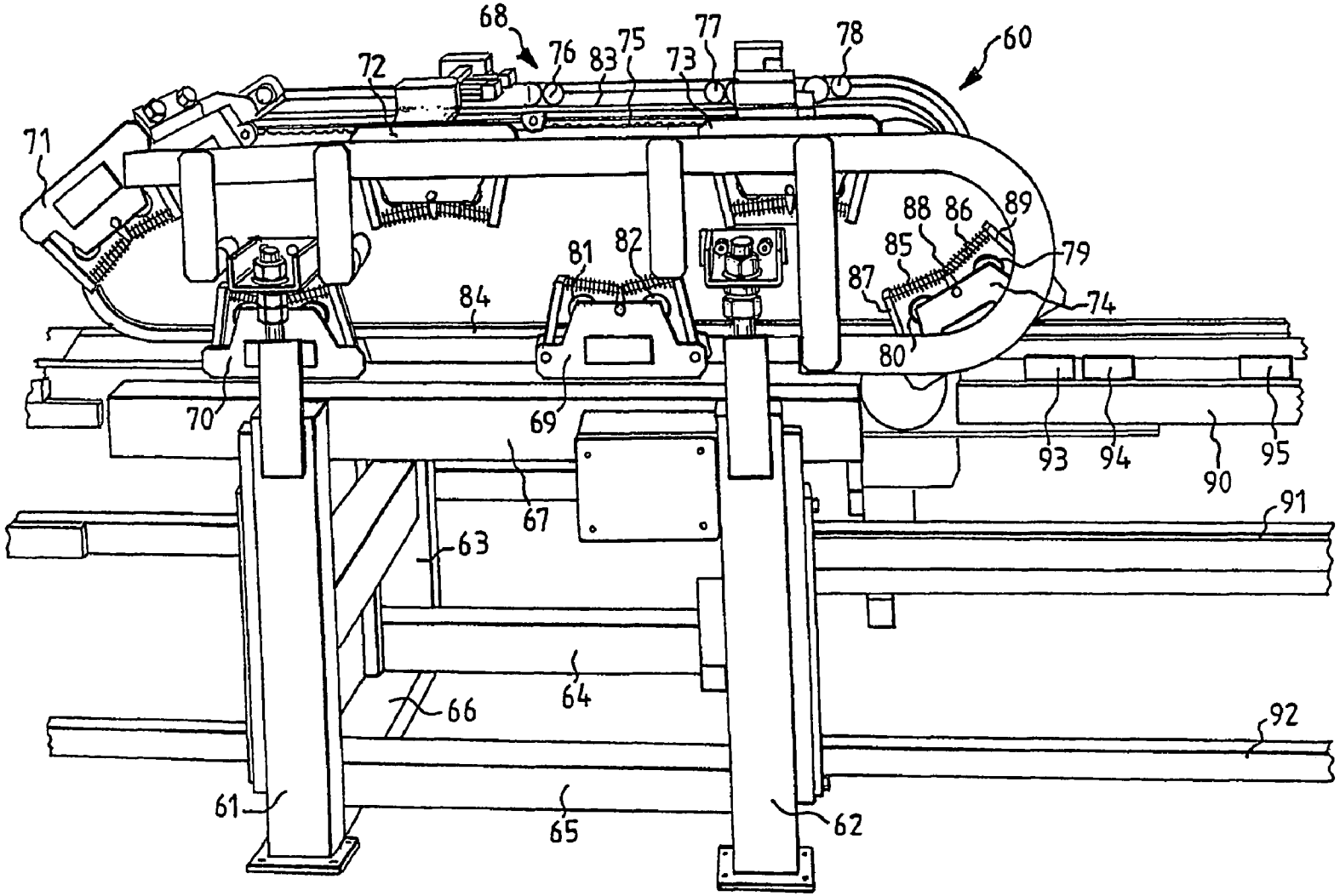
Figure 7:
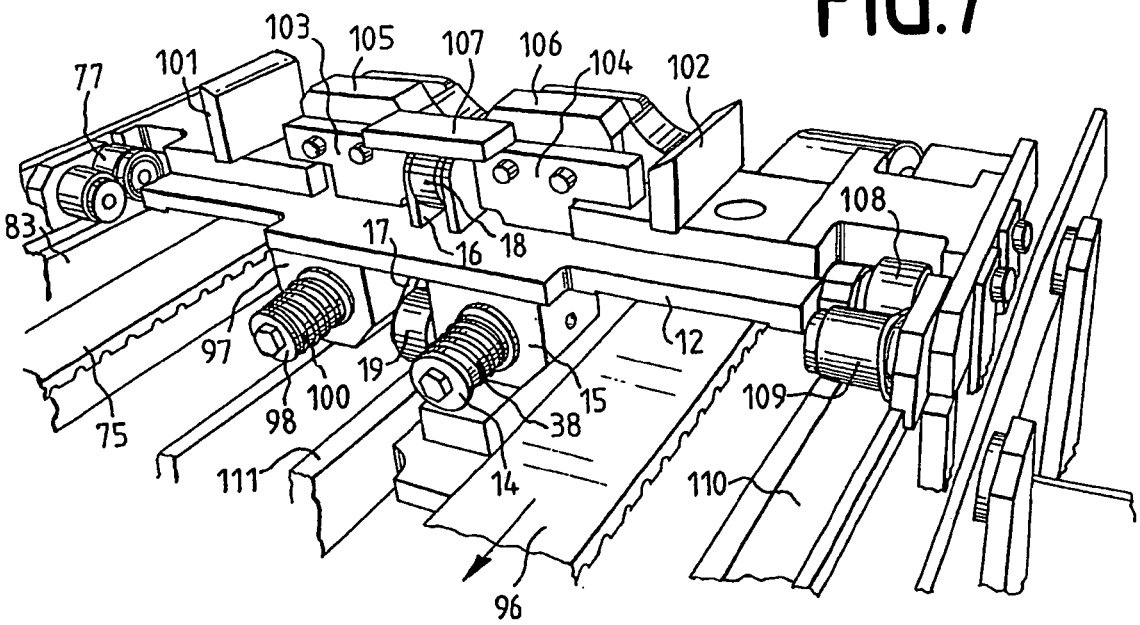
Figure 8:
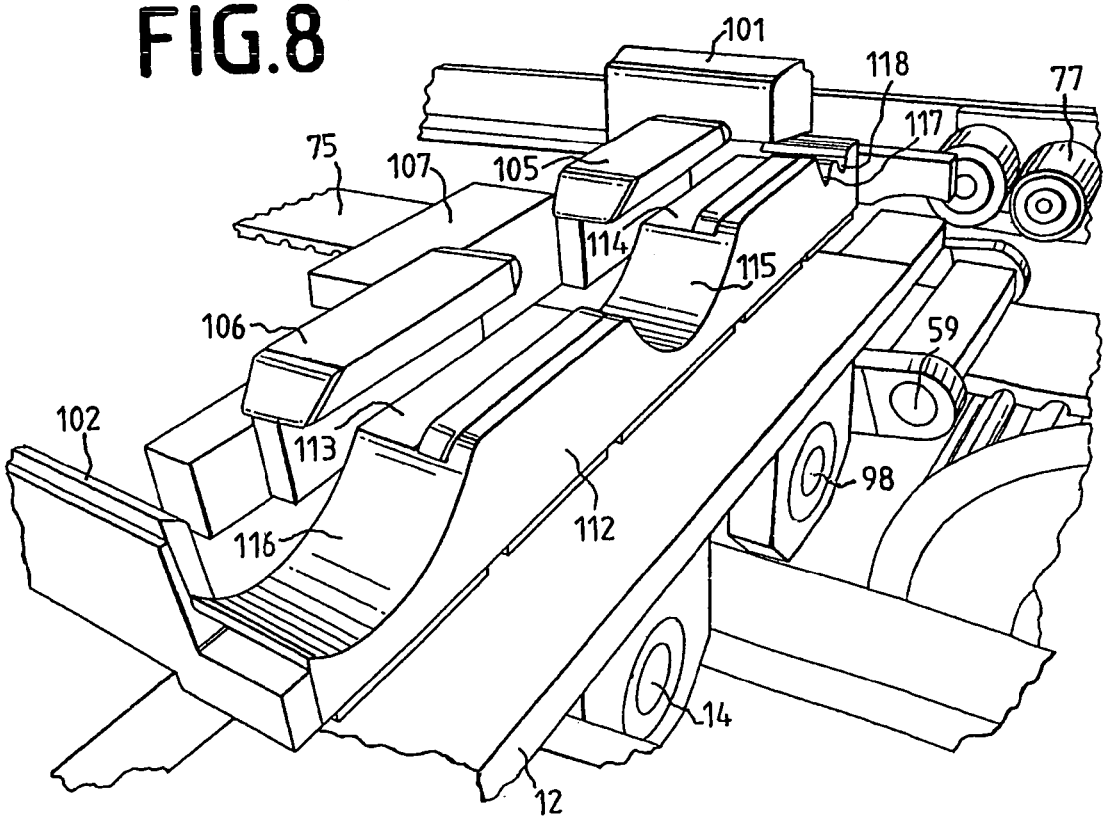
Figure 9:
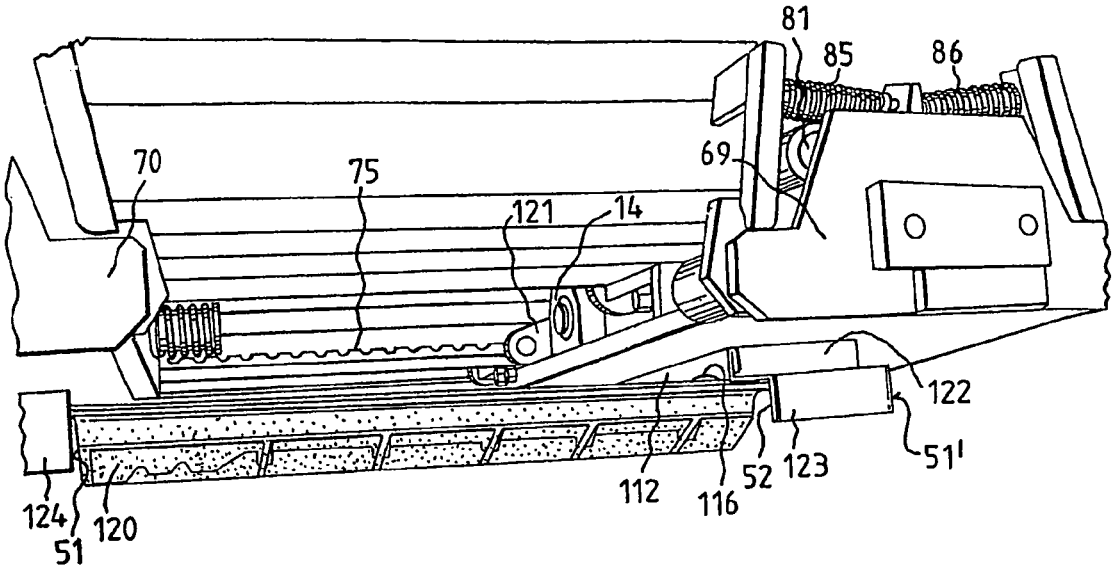
Figure 10:
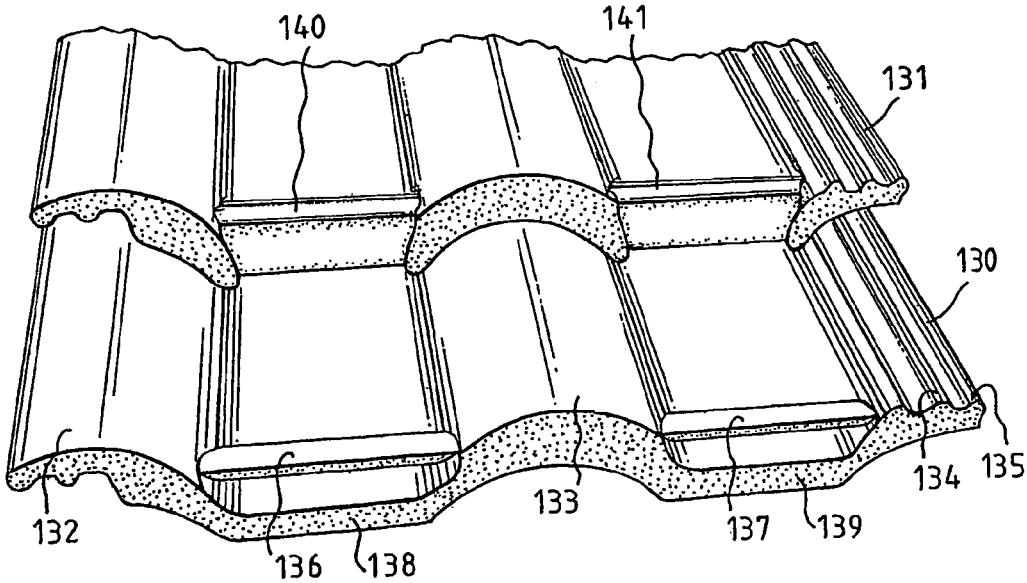

Embodiment examples of the invention are depicted in the drawings and will be described in detail in the following. In the drawings depict:

FIG. 1 a molded unfinished roofing tile with working tools before the working, FIG. 2 the molded unfinished roofing tile with working tools according to FIG. 1 during the working, FIG. 3 a device for the production of a water barrier of a molded unfinished roofing tile, FIG. 4*a* a first transporting device for a roofing tile to be worked in a first position, FIG. 4*b* the first transporting device for a roofing tile to be worked in a second position, FIG. 5 a second transporting device for several roofing tiles to be worked, FIG. 6 an overall view from the side of a device for the production of water barriers, the device being disposed on a carrier, FIG. 7 a partial view onto the top side of the device depicted in FIG. 6, FIG. 8 a partial view according to FIG. 7, however, viewed from the right instead of from the left side, FIG. 9 the disposition of a roofing tile during the production of a water barrier with the device according to the invention, FIG. 10 two roofing tiles with different water barriers.

FIG. 1 depicts a molded unfinished roofing tile 1 produced according to the method described in AT 400 120 B. The molded unfinished roofing tile 1 is to be provided with a water barrier, which is carried out in a forming station integrated into a roofing tile production loop, which succeeds a roofing tile machine. The molded unfinished roofing tile 1 is located on the lower mold half 2 serving as a carrier. Above the right end of the molded unfinished roofing tile 1 a forming part 3 is disposed, which is opposed by a ram 4. The ram 4 is held by a holding element 5. The fastening of the holding element 5 is not shown.

The molded unfinished roofing tile 1 is not yet cured while it is being worked, i.e. the material of which it is comprised is still moldable. As the material, concrete is preferably provided. Such a molded unfinished roofing tile is also referred to as green roofing tile.

When the ram 4, which has a slanted front end 6, moves toward the green roofing tile, its tip 7 comes into contact with a point of the front face 8 of the green roofing tile 1. If the ram 4 is moved further to the left, it lifts the upper portion of the front region of the green roofing tile 1 upwardly and presses it into a recess 9 of the forming part 3.

FIG. 2 shows the position of the ram 4 at the end of the working process. It is evident that the right end of the green roofing tile 1 is divided into two subportions 10, 11, of which subportion 11 forms the water barrier. After the forming part 3 and the ram 4 are removed, a completed green roofing tile 1 with water barrier 11 is obtained, which now only needs to cure.

In practice the method described in conjunction with FIGS. 1 and 2 is more complicated in so far as it is not a static method, i.e. the green roofing tile 1 is not stationary, but it moves during the working process at relatively high speed from the right to the left. The tools 3 and 4 must virtually trail after the moving green roofing tile.

FIG. 3 shows in section a device with which the green roofing tile 1 with water barrier 11 can be produced during its transportation. This device will be referred to in the following as carriage 39. Evident is herein again the green roofing tile 1, the lower half of the mold 2, the forming part 3, the ram 4 and the holding element 5. The forming part 3 is connected with a plate 12, which is coupled on its top side with a sleeve 13, through which a horizontal piston 14 is guided. The plate 12, which has an approximately centrally located opening 23, has at its right side 26 a further sleeve 15, through which the piston 14 is guided. The holding element 5 is fixedly connected with this piston 14, such that a horizontal movement of the piston 14 also causes a horizontal movement of the holding element 5 and conversely.

About the right end of piston 14 is wound a helical spring 38, which is stayed on the sleeve 15 and presses the piston 14 toward the right. A left movement of this piston 14 can consequently only take place against the force of the spring 38.

To the right of the holding element 5 is located a lever with two lever arms 16, 17 which form an obtuse angle. At each of the ends of these lever arms rollers 18, 19 are provided, while the connection site of the two lever arms 16, 17 rests in a pivot bearing 20. The roller 18 is in contact on the holding element 5. Roller 19, in contrast, is in contact on the bottom side of a stationary cam 21.

The ram 4, the forming part 3 and the lever arms 16, 17 are moved from the right to the left by means of a conveyor belt or a toothed belt. During the working process the speed [of the belt] corresponds to the speed of the green roofing tile 1 at which the latter is moved from right to left. When the roller 19 reaches the central region 99 of the stationary cam 21, which is convexly arched downwardly, the roller 19 is pressed downwardly.

Thereupon the two lever arms 16, 17 rotate in the clockwise direction about the pivot bearing 20, cf. arrow 25, whereby the roller 18 pushes the holding element 5 toward the left. This holding element 5, in turn, moves the ram 4, fixedly connected with it, to the left, which, as already described, presses material of the green roofing tile 1 into the recess 9 of the forming part 3. The piston 14 is herein also shifted to the left against the force of spring 38. After a certain length of time, the roller 19 arrives again at a non-arched site of the cam 21, such that the ram 4 pulls back. The pulling-back of the ram is accelerated by the spring 38 which is guided about the right end of piston 14.

The next green roofing tile 27 can now be worked by means of another carriage, not shown in FIG. 3. The working of the second green roofing tile 27 is carried out in the same manner as has already been described in connection with the green roofing tile 1. The lower mold halves 2, 28 are lower mold halves disposed on a conveyor belt 29, which can be moved in the direction of arrow 30. By 31, 32 are denoted stops formed by the edges of a plate 49 located behind the ram 4. In front of the ram 4 is located a further plate, not visible in FIG. 3.

The cam 21 is supported swivellably about a pin 58 on the left side and on the right side is connected with a compressed air cylinder 22 which maintains the cam 21 in a horizontal position. If in the deformation of the green roofing tile 1 resistance forces of too great a magnitude are generated, since, for example, the length of the green roofing tile varies marginally due to limited finishing and correspondingly more unset cement must be deformed, the force acting upon the cam 21 overcomes the force of the compressed air cylinder 22, such that the cam 21 can escape upwardly to provide removal of the load. It is also feasible to turn the entire end 10, 11 of the green roofing tile 1, and not only a subportion 11, if the ram 4 and the recess 9 are made larger.

FIGS. 4*a* and 4*b* show the principle of a transporting device with which a green roofing tile 1 with its lower mold half 2 can be moved into a working position. This transporting device differs from the transporting principle shown in FIG. 3. Green roofing tile 1 and lower mold half 2 in this configuration are located on a, not shown, carrier which is moved from the right to the left by two parallel conveyor lines.

In FIGS. 4*a* and 4*b* only one conveyor line 57 is evident. By means of a lifting platform 34, which includes a stop 35 and is connected with a compressed air cylinder 36, the green roofing tile 1 is lifted together with the lower mold half 2 upwardly into the working position. The lifting platform 34 in the process moves between the two conveyor lines 57. The working position is reached when the surface of the green roofing tile 1 abuts the forming part 3.

The lower mold half 2 is decelerated by friction with the lifting platform during the crossover from the conveyor lines 57 to the lifting platform 34, since the lifting platform 34 is raised during the arrival of the lower mold half 2. With the aid of a not shown compressed air cylinder the lower mold half 2 is moved up to the stop 35. In this position, shown in FIG. 4*b*, the green roofing tile 1 is worked in the manner already described by means of ram 4 and forming part 3.

After the green roofing tile 1 has been provided with the water barrier 11, it is deposited again by means of the lifting platform 34 on the transporting device and transported to the left. With the same device the next green roofing tile coming from the right can now be worked.

The method depicted in FIGS. 4*a* and 4*b* for the production of a water barrier is especially suited if smaller quantities of roofing tiles are produced, for example 15 concrete roofing tiles per minute.

Since for all green roofing tiles which are delivered successively the same working device is utilized, the working of a new green roofing tile can only take place after the working of the preceding green roofing tile has been completed. The supply of lower mold halves 2 to the forming station 40 to 43, the closed path 45 is therefore, as a rule, interrupted during the working of a green roofing tile 1. However, an interruption is not required if the distance between two green roofing tiles is so great that the just worked green roofing tile is finished and can be deposited before the next green roofing tile arrives.

During the working of the green roofing tile 1, the ram 4 and the forming part 3 do not move with the conveyor line 57 to the left, i.e. they are disposed such that they are stationary.

A method, resting on the principle depicted in FIG. 3, for the production of a water barrier, with which a fabrication cycle of up to 120 concrete roofing tiles per minute can be realized, is shown in the schematic diagram of FIG. 5. This FIG. 5 represents a side view of a device containing several of the carriages 39 shown in FIG. 3. These carriages are denoted by 40 to 43 in FIG. 5.

One forming part 3-3''' each is fixedly and one ram 4-4''' each is movably disposed on one of these carriages 40 to 43, which move in the clockwise direction on a closed path 45 and are driven by a toothed belt. In order to absorb the forces generated by the forming out of the green roofing tile 47, the lower mold half 53 located on a carrier 44 is guided and additionally fixed through a stop 51 of a first carriage 43 and a slider 52 of a second following carrier 42. Stop 51 and slider 52 are therein realized by rear and front edges of plates 49, 49', 49", 49"', of which each carriage 40 to 43 includes one.

Since for the forming out of the water barrier on the green roofing tile 47 a certain length of time is required, several carriages 40 to 43 must be available on the closed path 45 for the working of further roofing tiles 46, 48 and they must be guided parallel to the carrier 44 during the forming out. With reference to FIG. 5, the working does not take place through the upper carriages 40 and 41 but only through the carriages 42, 43, each of which moves in the lower region.

In order to prevent any relative movement between the forming part 3-3"' disposed on the carriage 40 to 43 and the green roofing tile 1 itself, the particular working carriage, for example 42, by means of the slider 52 with integrated centering assumes the further transport in the conveying device. If, for example, the green roofing tile 46 is pushed by the feed conveyor means 50 onto the carrier 44 when the carriage 44 still assumes the position of carriage 41, this displacing ends when there is no longer contact between the roofing tile 46 and the feed conveyor means. The carriage 42 with its slider 52 now drives against the right end of the green roofing tile 46 or its lower mold half 55 and pushes the lower mold half 55 to the left up to stop 51 of carriage 43.

One stop 51 and one slider 52 are located on each plate 49, 49', 49", 49"' of one of the carriages 40 to 43.

The carriages 40 to 43 on the closed path 45 are connected with one another such that the distance d between stop 51 of carriage 43 and slider 52 of carriage 42 corresponds to the length d of the green roofing tile 47 with lower mold half 53.

The toothed belts and the carriages 40 to 43 are connected with one another through an articulation 59 (FIG. 8), such that a carriage, for example carriage 42, during the acceptance can straighten itself in accordance with the green roofing tile 47 with lower mold half 52 and the forming part 3" is placed onto it at the desired site.

After the working, the green roofing tile 47 is supplied to the removal conveyor 56 and further transported as green roofing tile 48. The removal conveyor 56 and the feed conveyor 50 are integrated into a roofing tile production loop, in which is also disposed the roofing tile machine disclosed in FIG. 1 of AT 400 120 B.

The conveying speed of the feed conveyor 50 is such that between the roofing tiles 46, 47 a gap f is formed whose length is greater than the distance between stop 51 and slider 52 of the same plate 49" of the same carriage 42.

Carriages 40 to 43 drive with a higher velocity of circulation than is required for one working cycle. By working cycle is here understood the number of green roofing tiles worked per minute. Thereby the number of green roofing tiles supplied does not become greater than the number that can be worked.

By decreasing the velocity of circulation of the carriages 40 to 43 it is made possible that the concrete roofing tile 46 with lower mold half 55 overtakes stop 51 of carriage 42. The magnitude of the speed reduction depends on the actual length of gap f between the concrete roofing tiles 46, 47 with lower mold halves 55, 53. After the green roofing tile 46 with lower mold half 55 has overtaken the stop 51 of carriage 42, the velocity of circulation of carriages 40 to 43 is increased again. The next carriage, as already described, pushes the green roofing tile further. Through an appropriate speed sequence the adaptation also takes place of the working cycle of the device shown in FIG. 5 to the working cycle of the concrete roofing tile machine according to FIG. 1 of AT 400 120 B. After the forming out of the water barrier, the concrete roofing tile 47 with lower mold half 53 is pushed onto the removal conveyor 56. The conveyor speed of the removal conveyor 56 is marginally below the velocity of circulation of carriages 40 to 43. Only after the forming part 3" has left the concrete roofing tile 47 with lower mold half 53, is the speed of the removal conveyor 56 increased and the concrete roofing tile 48 with lower mold half 54 extracted.

Consequently, first the lower mold halves 53, 54, 55 coming from a roofing tile machine with the green roofing tiles 46, 47, 48 located thereon are supplied by means of a feed conveyor 50 to a forming station 40 to 43, 45. Hereupon a supplied lower mold half 53 is pressed by a slider 52 of a first carriage 42 onto stop 51 of a second carriage 43. The carriage 42 during this movement is subsequently guided past the cam 21, with the ram 4 forming the water barrier on the green roofing tile 47 by means of the lever mechanism 16, 17. The stop 51 subsequently leaves the lower mold half 53, and the lower mold half 53 is pushed by the slider 52 onto the removal conveyor 56.

FIG. 6 shows in greater detail the device according to FIG. 5, which in the latter figure is only shown in principle, once again in a schematic perspective representation.

The device 60 according to FIG. 6 includes a supporting frame comprised of several vertical and horizontal struts 61 to 67, on which is located a transporting device 68 with overall six carriages 69 to 74. These carriages 69 to 74 are moved about the transporting device 68 by means of toothed belt 75. The guidance of the carriages 69 to 74 takes place via wheels 76 to 82, which run on guidance webs 83, 84 provided within and outside of the transporting device 68. In addition are evident springs 85, 86 opposite the wheels 79, 80, which are connected with bars 87, 88, 89. These springs 85, 86 serve the purpose of always pressing the wheels 79, 80 firmly onto the wheel guidance and specifically also when the wheels 79, 80 are in the curved region of the wheel guidance, where they have a different distance from one another than in the straight region.

A portion of the feed conveyor means 50 according to FIG. 5 for the roofing tiles is indicated through horizontal struts 90, 91, 92. At the upper edge of the feed conveyor means optical sensors 93, 94, 95 are disposed, which detect beginning or end of the roofing tiles arriving from the right and effect the switching on and off of certain processes. Sensor 93, for example, monitors the gap between two green roofing tiles, while sensor 94 serves for synchronization. Sensor 95 serves for switching the equipment, depicted in FIG. 6, on and off.

FIG. 7 shows a view onto the carriage 73 according to FIG. 6, and specifically seen from left to right. Compared to the representation of FIG. 3, the carriage 73 is rotated about 180 degrees since it is on the top side, thus in the non-working position. It is evident that opposite the toothed belt 75 seen in FIG. 6 is a second toothed belt 96.

The rollers 18 and 19, which are located on the lever arms 16 and 17, are disposed between two sleeves 15 and 97, in which pistons 14 and 98 are guided. About the ends projecting from the sleeves 15 and 97 are provided springs 38, 100, which retrieve the piston 14, 98 again after the lever arms 16, 17 have completed the pivot movement described in connection with FIG. 3.

On plate 12 are located elements 101, 102; 103, 104, the rams 105, 106 and the part 107. By 77, 108, 109 are denoted guidance wheels, which roll out on a web 110 or 83, respectively. A guidance rail 111 guides the roller 19 of the lever. On the bottom side of the carriage 73 the guidance rail 111 in terms of function corresponds to the cam 21 depicted in FIG. 3.

FIG. 8 shows the configuration according to FIG. 7 viewed from the right instead of from the left side. The forming part 112 is evident which, in terms of function, corresponds to the forming part 3 in FIG. 3. The rams 105, 106 in terms of function correspond to the ram 4 in FIG. 3. Between the wheel 77 and the piston 98 can be seen an articulation, which connects a belt with a carriage.

By 113, 114 are denoted recesses, which in terms of function correspond to the recess 9 of FIG. 3. Between these recesses 113, 114 is a trough 115. A further trough 116 is to the left of recess 113, while to the right of recess 114 are provided two grooves 117, 118. These troughs 115, 116 and the grooves 117, 118 are adaptations to the outer contours of a special roofing tile. This special roofing tile in the embodiment example of FIG. 6 to 8 receives two water barriers, which are provided between already present elevations of the roofing tile. Such a roofing tile is depicted in FIG. 10.

FIG. 9 shows a cut-out of FIG. 6, in which a roofing tile 120 is on the bottom side—thus on the working side, and specifically between the two adjacent carriages 69 and 70. Evident are here the forming part 112 and the trough 116 as well as an end of piston 14. In addition, a metal sheet 122 with an L-shaped section 123 can be seen. Carriage 70 has also a corresponding metal sheet 124 with a vertical edge 51. The section 123 of metal sheet 122 has a front edge 52 and a rear edge 51'.

In terms of function the rear edge 51' corresponds to the stop 51 in FIG. 5. The corresponding edge 52 of section 123 corresponds to the slider 52 in FIG. 5.

FIG. 10 shows the top side of two roofing tiles 130, 131, with the roofing tile 131 lying on roofing tile 130. These top sides of the roofing tiles 130, 131 correspond to the top side of forming part 112 in FIG. 8. In the lower roofing tile 130 between two arcuate elevations 132, 133 and the flutes 134, 135, there are recognized two water barriers 136, 137 produced according to the invention, which are half margins turned upwardly.

The water barriers 136, 137 correspond in terms of function to the subportion 11 according to *Fig.* 2, while the sections 138, 139 correspond to the subportion 10 according to FIG. 2.

In the upper roofing tile 131 the water barriers 140, 141 are comprised of completely turned end portions. Thus, there is no portion corresponding to the subportion 10 of FIG. 2.

The invention claimed is:

1. Method for the production of a water barrier in a roofing tile not yet hardened, characterized by the following steps:

a) lower mold halves (53, 54, 55) coming from a roofing tile machine with the green roofing tiles (46, 47, 48) thereon are supplied to a forming station (40 to 43, 45) by means of a feed conveyor (50), b) a supplied lower mold half (53) is pressed by a slider (52) of a first carriage (42) onto a stop (51) of a second carriage (43), c) the first carriage (42) is guided along a cam (21), with the ram (4) forming the water barrier (11) onto the green roofing tile (47) by means of a lever mechanism (16, 17), and d) the stop (51) is subsequently removed and the lower mold half (53) is pushed by the slider (52) onto a removal conveyor (56).

2. Method for the production of a water barrier in a roofing tile not yet hardened, as claimed in claim 1, characterized in that the feed conveyor (50) pushes the green roofing tile (46) with its lower mold half (55) onto a tray (44) and the lower mold half is pushed further by means of a slider (52) of a carriage (42).

3. Method for the production of a water barrier in a roofing tile not yet hardened, as claimed in claim 2, characterized in that the conveying speed of the removal conveyor (56) during the crossover of the lower mold half (53) onto the removal conveyor (56) is initially lower and during the detaching of the slider (52) from the lower mold half (53) is higher than the velocity of circulation of the carriages (40 to 43).

4. Method for the production of a water barrier in a roofing tile not yet hardened, as claimed in claim 3, characterized in that between two successive lower mold halves (53, 55) a distance (f) is generated in each instance, such that the crossover of a lower mold half (55) into a working position, the forming of the water barrier (11) and the reinsertion of a lower mold half (53) into a removal path (56) is not hindered by the succeeding lower mold half (55).

5. Method for the production of a water barrier in a roofing tile not yet hardened, as claimed in claim 4, characterized in that the conveying speed of the forming station (40 to 43, 45) is greater than the conveying speed of the feed conveying means (50).

6. Method for the production of a water barrier in a roofing tile not yet hardened, as claimed in claim 1, characterized in that the conveying speed of the removal conveyor (56) during the crossover of the lower mold half (53) onto the removal conveyor (56) is initially lower and during the detaching of the slider (52) from the lower mold half (53) is higher than the velocity of circulation of the carriages (40 to 43).

7. Method for the production of a water barrier in a roofing tile not yet hardened, as claimed in claim 1, characterized in that between two successive lower mold halves (53, 55) a distance (f) is generated in each instance, such that the crossover of a lower mold half (55) into a working position, the forming of the water barrier (11) and the reinsertion of a lower mold half (53) into a removal path (56) is not hindered by the succeeding lower mold half (55).

8. Method for the production of a water barrier in a roofing tile not yet hardened, as claimed in claim 1, characterized in that the conveying speed of the forming station (40 to 43, 45) is greater than the conveying speed of the feed conveying means (50).

9. A method for the production of a water barrier in a roofing tile not yet hardened, said method comprising:

moving lower mold halves with green roofing tiles thereon by means of a feed conveyor from a roofing tile machine to a forming station comprising a plurality of carriages;

forming a water barrier onto a first green roofing tile disposed on a first lower mold half using a ram disposed on a first carriage, and then moving said first lower mold half onto a removal conveyor;

forming a water barrier onto a second green roofing tile disposed on a second lower mold half using a ram disposed on a second carriage, and then moving said second lower mold half onto said removal conveyor;

pressing said first lower mold half using a slider of said first carriage against a stop of a third carriage disposed ahead of said first carriage in the direction of movement of said carriages to guide and hold said first lower mold half during forming of said water barrier onto said first green roofing tile; and pressing said second lower mold half using a slider of said second carriage against a stop of said first carriage to guide and hold said second lower mold half during forming of said water barrier onto said second green roofing tile.

10. The method according to claim 9, wherein said method further comprises:

removing said stops out of the path of movement of said lower mold halves upon forming of said water barrier; and said steps of moving said lower mold halves onto said removal conveyor comprises pushing said lower mold halves with said sliders.

11. The method according to claim 10, wherein said step of forming a water barrier comprises:

guiding one of said carriages past a cam;

engaging said cam with a lever system of said carriage and activating said lever system; and moving said ram with said lever system into said green roofing tile to form a water barrier thereon.

12. The method according to claim 11, wherein said forming station comprises a tray, and said method further comprises:

pushing, with said feed conveyor, said lower mold halves and the green roofing tiles thereon off of said feed conveyor and onto said tray; and pushing, with said sliders, said lower mold halves on said tray and then onto said removal conveyor.

13. The method according to claim 12, wherein said method further comprises:

operating said removal conveyor at a first speed lower than the speed of movement of said carriages; and disengaging said sliders from said lower mold halves upon movement of said lower mold halves onto said removal conveyor, and substantially simultaneously increasing the speed of said removal conveyor to a second speed higher than the speed of movement of said carriages.

14. The method according to claim 13, wherein said method further comprises forming and maintaining a distance between successive lower mold halves sufficient to minimize interference in the forming of the water barrier and the movement of the preceding lower mold half onto said removal conveyor by a succeeding lower mold half.

15. The method according to claim 14, wherein said method further comprises moving said carriages at a speed greater than the conveying speed of said feed conveyor.

* * * * *